US009945093B1

(12) United States Patent
Belliveau

(10) Patent No.: US 9,945,093 B1
(45) Date of Patent: Apr. 17, 2018

(54) EXCAVATOR, EXCAVATOR BOOM, STICK OBJECT COUPLER RECEIVER FOR THE SAME AND METHOD OF USING THE SAME

(71) Applicant: Paul R. Belliveau, Burton, OH (US)

(72) Inventor: Paul R. Belliveau, Burton, OH (US)

( * ) Notice: Subject to any disclaimer, the term of this patent is extended or adjusted under 35 U.S.C. 154(b) by 612 days.

(21) Appl. No.: 14/602,804

(22) Filed: Jan. 22, 2015

Related U.S. Application Data

(60) Provisional application No. 61/938,744, filed on Feb. 12, 2014.

(51) Int. Cl.
*E02F 3/36* (2006.01)

(52) U.S. Cl.
CPC ..... *E02F 3/3622* (2013.01)

(58) Field of Classification Search
CPC ..... E02F 3/3622; E02F 3/369; E02F 3/3663; E02F 3/3627; E02F 3/3659; E02F 3/382; E02F 3/3618; E02F 3/365; E02F 3/3668; Y10T 403/593; Y10T 403/591
USPC ..... 37/468, 403–411; 172/272, 273; 403/322.1, 322.3, 322.4, 324, 325; 414/686, 723
See application file for complete search history.

(56) References Cited

U.S. PATENT DOCUMENTS

| | | | |
|---|---|---|---|
| 3,672,521 | A | 5/1972 | Bauer et al. |
| 4,545,720 | A | 10/1985 | Cochran et al. |
| 5,403,144 | A | 4/1995 | Staben |
| 5,423,625 | A | 5/1995 | Gebauer et al. |
| 5,938,399 | A | 8/1999 | Knutson |
| 6,238,130 | B1 | 5/2001 | Youngers |
| 6,533,527 | B1 | 3/2003 | Inoue et al. |
| 6,533,529 | B2 | 3/2003 | Waggoner |
| 6,619,906 | B2 | 9/2003 | Dick |
| 6,922,926 | B2 | 8/2005 | Miller et al. |
| 7,108,475 | B1 | 9/2006 | Gustafson |
| 7,225,566 | B1 | 6/2007 | Kimble |
| 7,226,268 | B2 | 6/2007 | Gustafson et al. |
| 7,524,158 | B2 | 4/2009 | Eckstein et al. |
| 7,648,326 | B2 | 1/2010 | Santele et al. |
| 7,836,616 | B2 | 11/2010 | Esser et al. |
| 7,882,898 | B1 | 2/2011 | Vering et al. |

(Continued)

OTHER PUBLICATIONS

Photographs.
Photographs of Existing Coupler Designs, 1 page.

*Primary Examiner* — Robert E Pezzuto
(74) *Attorney, Agent, or Firm* — Rankin, Hill & Clark LLP

(57) ABSTRACT

An excavation machine and a coupler system for use on the excavation machine to allow a universal adaptor for the attachment of skid steer attachments to be joined directly to a working end of a main lifting boom of the excavation machine, the coupler system including a first coupler body having a first rearward portion and a first forward portion, the first rearward portion being connectable to the working end of the lifting boom, the first coupler body having a first mating arrangement, the coupler system further including a second coupler body that is secured or securable relative to the universal adaptor, the second coupler body having a second mating arrangement that is selectively securable to the first mating arrangement to selectively secure the universal adaptor directly relative to the working end of the lifting boom of the excavation machine thereby allowing the excavation machine to use both skid steer attachments such as an associated skid steer bucket attachment joined directly relative to the working end of the lifting boom and a traditional dipper stick.

18 Claims, 20 Drawing Sheets

(56) References Cited

U.S. PATENT DOCUMENTS

| | | | |
|---|---|---|---|
| 7,984,575 | B2 | 7/2011 | Robl et al. |
| 8,024,875 | B2 | 9/2011 | Wetzel et al. |
| 8,112,914 | B2 | 2/2012 | Miller et al. |

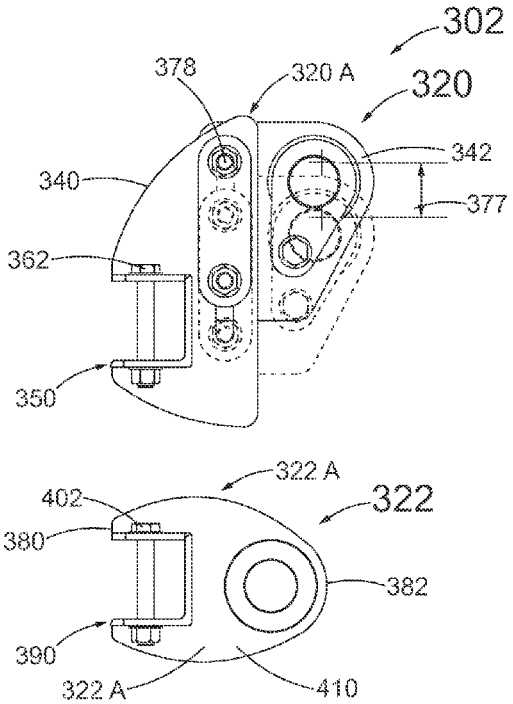
FIG. 25
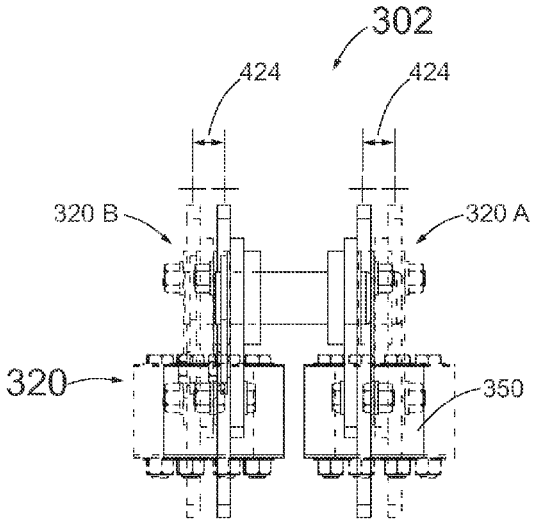
FIG. 26
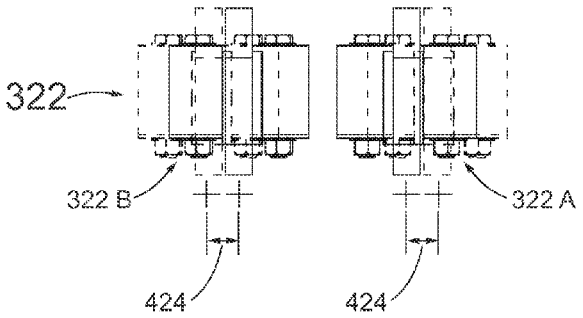

EXCAVATOR, EXCAVATOR BOOM, STICK OBJECT COUPLER RECEIVER FOR THE SAME AND METHOD OF USING THE SAME

This application claims priority to provisional patent application Ser. No. 61/938,744 filed on Feb. 12, 2014, which is incorporated by reference herein.

The invention of this application relates to excavators and; more particularly, to a coupler for an excavator and an excavator having a modified boom arrangement along with the coupler. The invention further relates to methods of using the same and attaching a working tool to the excavator.

INCORPORATION BY REFERENCE

There are "tool coupler attachment system's" available for excavator dipper sticks and under-carriages. Also there are couplers on the market for excavators. For example, patent number: U.S. Pat. No. 5,423,625 discloses a boom/arm coupler for an excavator. Patent number: U.S. Pat. No. 6,533,527 discloses a boom and boom cylinder quick coupler. Patent number: U.S. Pat. No. 6,922,926 discloses a universal coupler for excavating buckets. Patent number: U.S. Pat. No. 7,984,575 discloses a quick coupler assembly. Patent number: U.S. Pat. No. 8,112,914 fully automatic coupler for excavator arm. Patent number: U.S. Pat. No. 8,024,875 discloses a compact excavator implement interface. Patent number: U.S. Pat. No. 3,672,521 discloses a quick attachment device. Patent number: U.S. Pat. No. 4,545,720 discloses a quick coupler assembly. Patent number: U.S. Pat. No. 6,238,130 discloses a coupling device for a skid steer. Patent number: U.S. Pat. No. 6,619,906 discloses a power latch adapter for quick change attachment coupler. Patent number: U.S. Pat. No. 7,524,158 discloses an adapter for mounting skid-steer loader attachments onto an excavator arm. Patent number: U.S. Pat. No. 7,836,616 discloses a loader coupler with multiple pick-up locations. Patent number: U.S. Pat. No. 7,836,616 discloses a loader coupler with multiple pick-up locations. Patent number: U.S. Pat. No. 7,225,566 discloses a hybrid male coupler portion for a front-end loader. Patent number: U.S. Pat. No. 7,882,898 discloses a quick coupler. All of these patents are incorporated by reference into this specification as background material and form a part thereof.

BACKGROUND OF THE INVENTION

Many modern excavating, construction, agricultural and/or demolition work machines are capable of using a wide variety of work tools allowing a single "core machine" to accomplish many different types of tasks by simply changing the working tool. Over the years many different work tool attachment devices have emerged to make the process of changing a work tool quick and efficient.

The device is affixed, or mounted at the location where a standard work tool would normally be mounted to the core machine. Then, once the device is mounted, the device has features to quickly attach to, and detach from work tools that have mating geometry, i.e. attachment Plate(s) and Pin(s).

Many of the tool mating components are standardized across the industry, so many different equipment manufactures, as well as attachment tool manufactures, can produce products that can attach to a wide range tools from a wide range of manufacturers. However, manufacturers do not produce devices that allow the tools of one type of construction work machine to be used on other types of work machines.

Examples of construction work machines that commonly use attachment tool devices include excavators, skid-steer loaders, track loaders, wheel loaders, front-end loaders/backhoe Loaders and tele-handlers.

SUMMARY OF THE INVENTION

The invention of this application relates to excavators and; more particularly, to an excavator having a modified boom arrangement along with a coupler and/or coupler system for using the same. The invention further relates to methods of using the same and attaching working arms (i.e. dipper sticks); as well as other working tools including non-excavator working tools, and/or other attachment coupler types to the working end of the boom of an excavator.

More particularly, according to certain aspects of the invention, provided is a coupler and/or coupler system for an excavator boom that allows the dipper stick to be quickly and easily removed and re-attached to the excavator. As a result, a plurality of alternative dipper sticks, as well as working tools and/or other attachment coupler types can be quickly and easily attached and detached to the boom-end of an excavator.

The coupler, according to other aspects of the invention, functions generally as a dipper stick connection coupler, that is, the coupler can be attached to the boom-end of the excavator, typically where the factory "dipper stick" attaches to the machine. Once installed, the features of the coupler are then used to quickly attach to and detach from any assortment of alternative dipper sticks (i.e. long sticks, sticks with special features like thumbs, etc.), working tools, and/or other attachment coupler types, i.e. skid steer adapter couplers for attachment to skid steer tools that all easily mate to the coupler for a wide range of additional machine uses.

A goal of the invention of this application is to provide a quick and easy means of attaching to and detaching from dipper sticks; working tools; and/or other attachment coupler types, i.e. skid steer adapter coupler to attach skid steer working tools to the boom-end of the excavator.

Thus, another set of objects is a coupler and/or system that has the ability to quickly and easily attach to and detach from dipper stick objects thereby allowing the operator to quickly attach to; use; and detach from an assortment of alternative dipper sticks (i.e. Standard factory stick, Long stick, Sticks with tools like thumbs, grapples, shears, etc.), all of which have functional advantages and disadvantages as compared to each other. Thereby providing a means of easily switching between dipper sticks on a single "core" excavator machine has important functional benefits by allowing the operator to choose the dipper stick object with the most benefit for a specific machine application.

Yet another set of objects is a coupler and/or system that require no alterations to either the excavator boom or the dipper stick. In this respect, the dipper stick, or other attachments, connect to the host excavator's boom using the same factory pins that would hold the factory dipper stick, and likewise connects to the stick using it's' factory pin and bushing joints.

Even yet another set of objects is that the coupler and/or system according to the invention of this application allows other work tools and/or work tool coupler(s) that share dipper stick geometry and mating features and to be connected to the "boom-end" of the excavator. This is useful because by removing the "hinged" Dipper Stick, and connecting work tools directly to the new coupler, a "rigid-boom" work machine is created while advantageously maintaining the unique "revolving upper-structure" that is a built-in part of an excavator. Having a "rigid boom" gives the excavator the same advantages as other "rigid-boom" work machines (i.e. universal/non-excavator working tools, Skid Steer Loaders, Track Loaders, Wheel Loaders, Front-end Loaders/Backhoe Loaders, and Tele-handlers). This combination then, (rigid boom with a revolving upper structure) provides a work machine, capable of carrying a wide variety of work tools thus providing a work machine with unique capabilities that are very useful in many circumstances.

Even yet another object is a coupler and/or system that improves both the maintenance and transportation of the excavator by having the ability to quickly and easy attach to and detach from stick object assemblies (i.e.: dipper sticks; work tools; and/or other attachment coupler types).

In the specification of this application, it is noted that the terms upper, lower, forward, rearward, inner, outer, horizontal, vertical and/or outer, and the like, are general in their definitions and used to help orient components of the invention of this application, but are not to be interpreted strictly in that these systems are configured to articulate wherein they are general reference to the components when viewing the drawings.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein:

FIG. 25 is a side view of the coupler receiver shown in FIG. 23;

FIG. 26 is a side view of the coupler receiver shown in FIG. 23;

DESCRIPTION OF PREFERRED EMBODIMENTS

Figure 11:
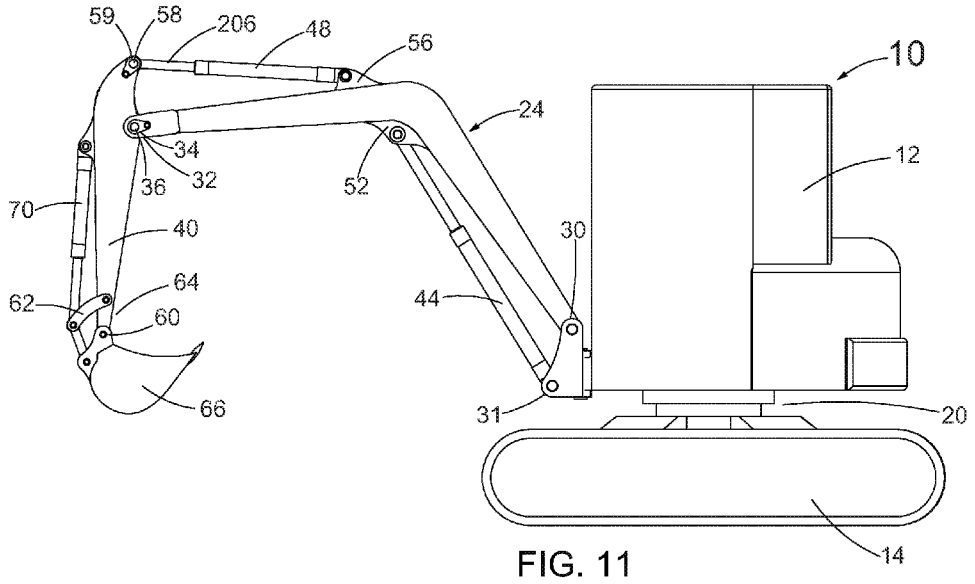
FIG. 11 is a side elevational view of an excavator before the installation of the coupler shown in FIG. 1.

Referring now to the drawings wherein the showings are for the purpose of illustrating preferred and alternative embodiments of the invention only and not for the purpose of limiting the same, FIG. 11 shows an example of an excavator 10. In that excavators are well known in the art, excavator 10 will not be discussed in detail herein in the interest of brevity. But, generally, excavator 10 includes a tractor upper structure 12 and an under carriage frame and drive system 14. Excavator 10 further includes a motor/bearing assembly 20 to allow for rotation of the upper structure relative to the under carriage frame. Excavator 10 has a boom 24 that is L-shaped with a base end 30 joined to upper structure 12 at a base bracket 31 and a distal end 32. Distal end 32 has a dipper stick hinge pin opening 34 shaped to receive a hinge pin 36 to join a dipper stick 40 to boom 24. Boom 24 further includes a boom cylinder 44 and a dipper stick cylinder 48. Boom cylinder 44 can be joined between base bracket 31 and a first central bracket 52. Boom cylinder 44 can be configured to control the up and down motions of boom 24. Dipper stick cylinder 48 can be joined between a second central bracket 56 and a dipper stick hinge pin 58 in a hinge pin opening 59. Cylinder 48 can be configured to control the rotation of the dipper stick about hinge pin 36. Dipper stick 40 can include attachment pins 60 and linkage 62 on a working end 64 to join a working tool 66 thereto. A working tool cylinder 70 can be utilized to rotate tool 66 relative to dipper stick 40. Again, all of this is known in the art wherein details relating to these components are well known in the art.

With reference to FIGS. 1-10, shown is a first set of embodiments of the invention of this application. In this respect, shown is a coupler or coupler system 100 according to certain aspects of the invention of this application. In that this component can be used alone and/or as part of a system relating to other aspects of the invention, it will be refereed to as a "coupler" in this initial description and will be described in later embodiments as a part of a system. Coupler 100 has a coupler body 102 generally extending between a top extent 104 and a bottom extent 105. As can be appreciated, while a preferred set of embodiments disclosed in this application show one or more assemblies, this is not required wherein portions of the body could be formed from a common structural component, such as a casting, without detracting from the invention of this application. The coupler body further extends between a rearward side 106 and a forward side 107, the forward side including an upwardly extending pin grabber hook 110 and the coupler body further including a lower hinge pin 112.

The upwardly extending pin grabber hook extends about a hook axis 114 and lower hinge pin 112 extends about a lower pin axis 116. Coupler 100 further includes an adjustment mechanism 120 to allow adjustment of a working distance or spacing 122 between axes 114 and 116. Adjusting the working distance allows coupler 100 to work in connection with a wider range of working tools and dipper sticks. In the embodiments shown, hook 110 is configured to be selectively adjustable linearly along a coupler axis 124. However, hook 110 and/or pin 112 could be adjustable without detracting from the invention of this application. Thus, the "distance" between the axes of lower hinge pin 112 and grabber hook 110 can be adjusted to exactly match the distance of the boom hinge pin 58 and dipper stick connection pin 36 of the mating stick object assembly in the machine shown in FIG. 11, which will be discussed in greater detail below.

In greater detail, coupler body 102 shown includes a rear coupler frame portion 130 having an upper attachment pin opening(s) 132 and a lower attachment pin opening(s) 134. One or more pins can be used to join or attach the coupler to excavator 10, which will be discussed more below. Rear frame portion 130 can have a U-shaped configuration including a central web 140 and side flanges 142 and 144. Yet further, frame portion 130 and coupler 100 can include one or more pass-thru openings 146 for hydraulic hoses to be routed through the center of the coupler similar to that of the factory stick. This opening can also provide access to the surfaces for assembly wherein components can be welded together, instead of bolted. Again, one or more of the separate components shown in the drawings of this application could be formed from a component unitary component, such as by casting, without detracting from the invention of this application. Attachment pin openings 132 and 134 can be a pair of openings in the side flanges. Coupler 100 further includes an upper forward assembly or portion 150 and a lower forward assembly or portion 152. Upper assembly or portion 150 includes hook 110 and lower assembly or portion 152 includes pin 112. Again, while these components are shown as assemblies separate from rear frame portion 130, this is not required wherein one or both assemblies could be formed from frame portion 130 and/or welded to portion 130.

Lower portion 152 includes coupler pin openings 160 to selectively support pin 112. In the embodiment shown, lower portion is also U-shaped and can have a lower base web 170 along with side webs 172 and 174. Openings 160 are in the side webs and the spacing of the side webs can be based on the application for coupler 100. Again, lower portion or assembly 152 could be formed from frame section 130 or be a separate assembly, but in the embodiments shown, lower assembly 152 is an assembly joined relative to web 140 of frame 130. Lower portion 152 can be fixed relative to frame section by any means known in the art including, welding, riveting and, fasteners and/or casting. As is shown, lower portion 152 can also include a lower plate opening 176 that corresponds with opening 146 and can be secured relative to frame section 130. As can be appreciated, fasteners could also be used.

Upper portion 150 can include a U-shaped carriage 180 and, in the embodiment shown, the carriage can be configured to move relative to rear frame portion 130 and thus relative to pin 112. In greater detail, carriage 180 can include a carriage frame 182 that is U-shaped with a carriage web 190, a left carriage flange 192 and a right carriage flange 194. Upper hook 110 can be a two piece hook with hook sections 200 and 202 separated from one another to allow space for a cylinder rod 206 of stick cylinder 48. Web 140 of frame section 130 can include a corresponding elongated hole, slot or opening(s) 210 to allow for working distance 122 adjustments. Locking fastener set(s) 212 can be utilized to selectively secure upper portion 150 relative to frame section 130 in a desired position. In this respect, fastener set(s) 212 can be loosened to allow relative movement and then tightened to maintain the desired working distance 122 between hook 110 and pin 112. This can allow the location of the hook to be moved in order to match to the exact pin centerlines of the mating stick object assembly, other working tool and/or a receiver, which will be discussed in greater detail below. Adjustment mechanism 120 can help this movement and to tighten the system when in place. The mechanism can be any mechanism to actuate upper portion 150 relative to lower portion 152. In the embodiments shown, coupler 100 includes a pair of height setting jacking bolts 220 to precisely adjust the vertical height of hooks 110 up or down. Height securing fastener set(s) 212 can move within slotted opening 210 in web 140 to allow for the adjustment. The fastener set(s) 212 are loosened when adjusting the hook, and then when the Hook is in the right position, they are tightened to secure the pin/hook spacing or position.

In yet other embodiments (not shown), this adjustment could incorporate a top wind jack, or electric or hydraulic cylinder for the same vertical adjustment purposes. In those cases, jack screws or another type of safety pin feature could be used to ensure the hook could not move down.

As is discussed throughout this specification, the invention of this application can come in many forms and can be produced in many configurations without detracting form the invention of this application. This can include, but is not limited to, assemblies or portions that are formed by multiple components welded and/or fastened together by a wide range of fastening systems. It can also include the use of forgings, castings and/or other manufacturing processes to create the configuration disclosed in this application. Yet even further, assemblies and/or portions can be combined to further improve performance and/or manufacturing characteristics.

Figure 1:
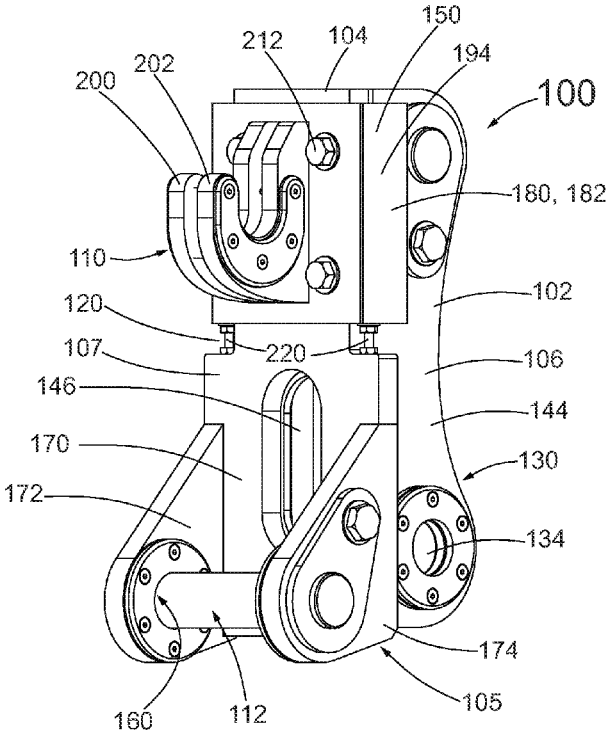
FIG. 1 is a front right side perspective view of a coupler according to certain aspects of the present invention.
Figure 2:
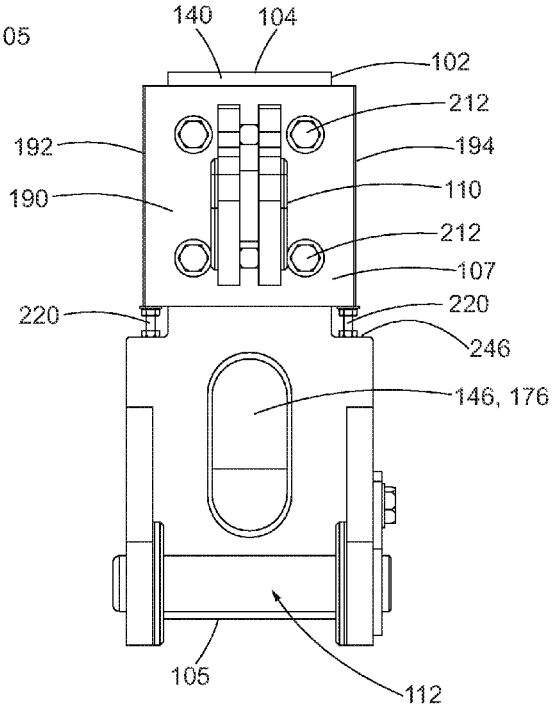
FIG. 2 is a front elevational view of the coupler shown in FIG. 1.
Figure 3:
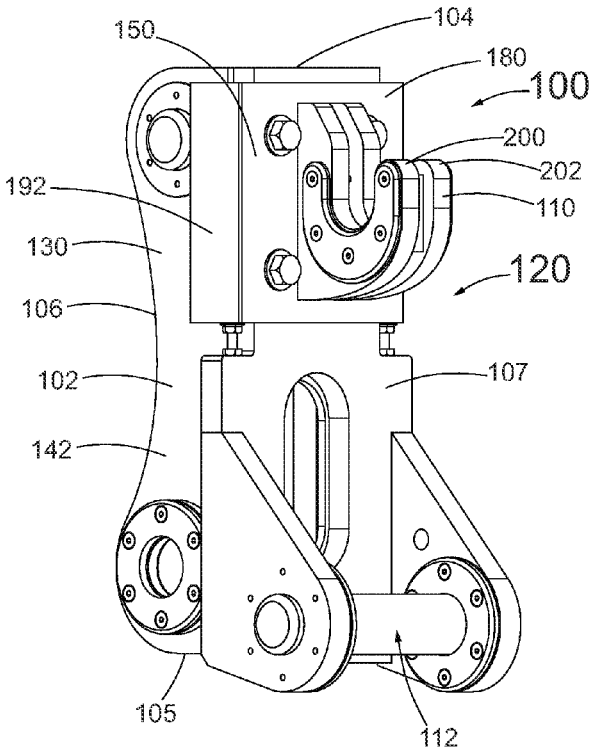
FIG. 3 is a front left side perspective view of the coupler shown in FIG. 1.
Figure 4:
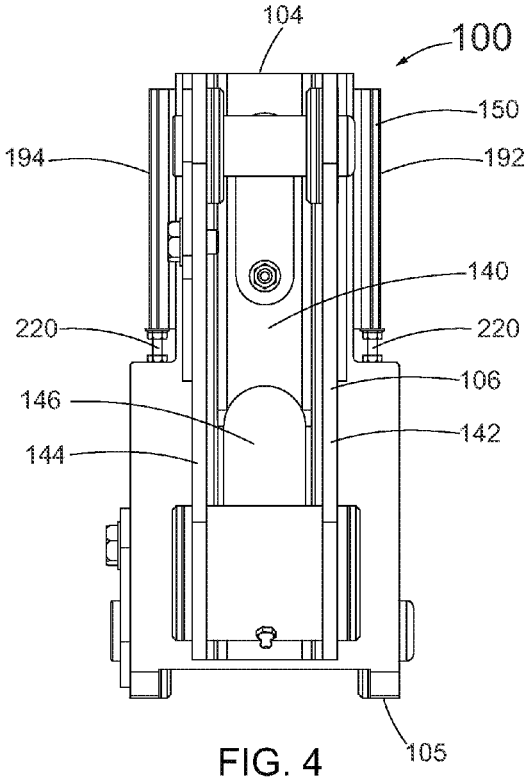
FIG. 4 is a back elevational view of the coupler shown in FIG. 1.
Figure 5:
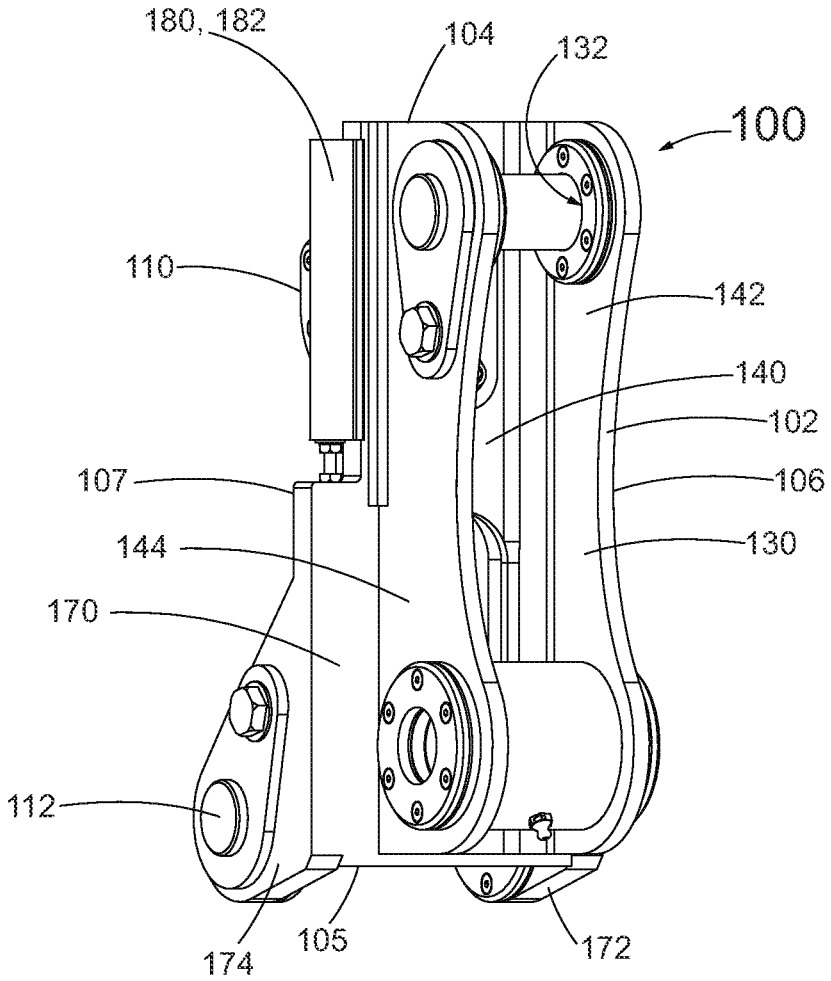
FIG. 5 is a back left side perspective view of the coupler shown in FIG. 1.
Figure 6:
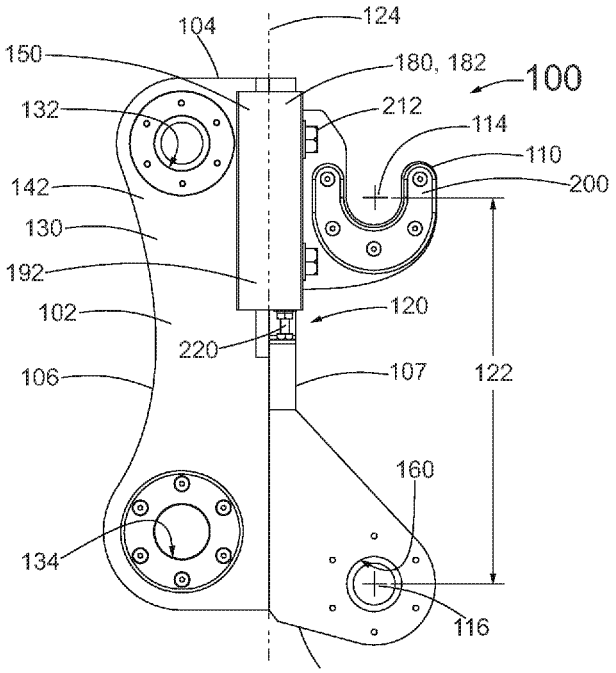
FIG. 6 is a left side elevational view of the coupler shown in FIG. 1.
Figure 7:
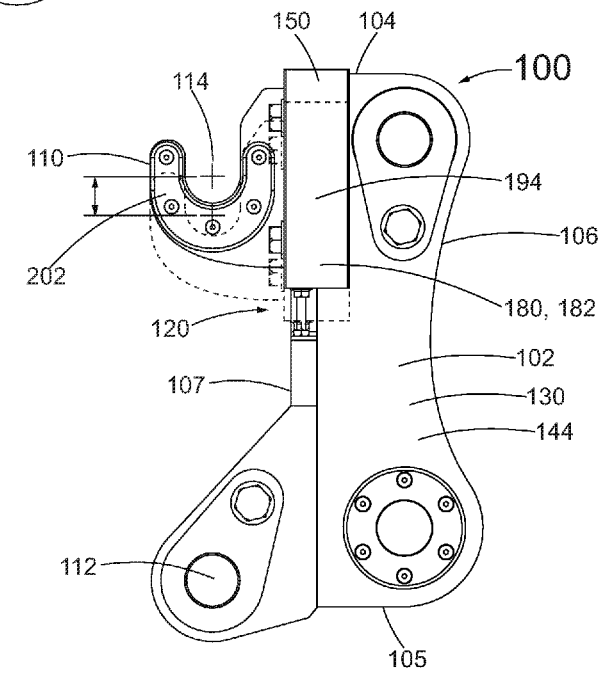
FIG. 7 is a right side elevational view of the coupler shown in FIG. 1.
Figure 8:
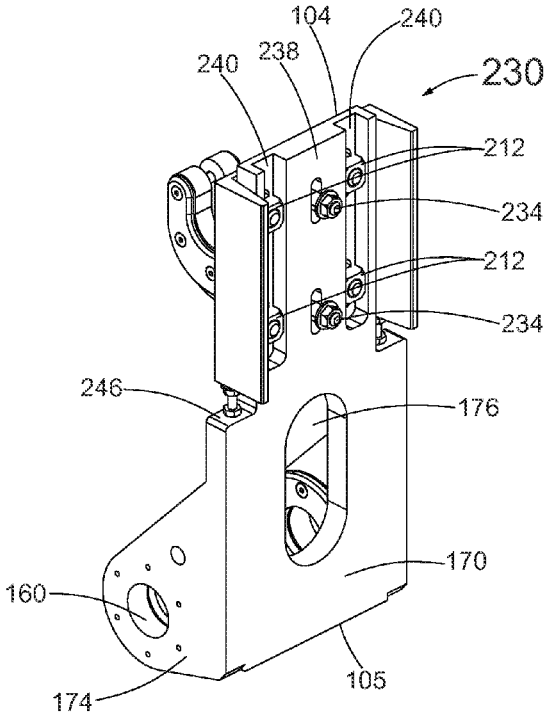
FIG. 8 is a rear perspective view of a front portion of the coupler shown in FIG. 1.
Figure 9:
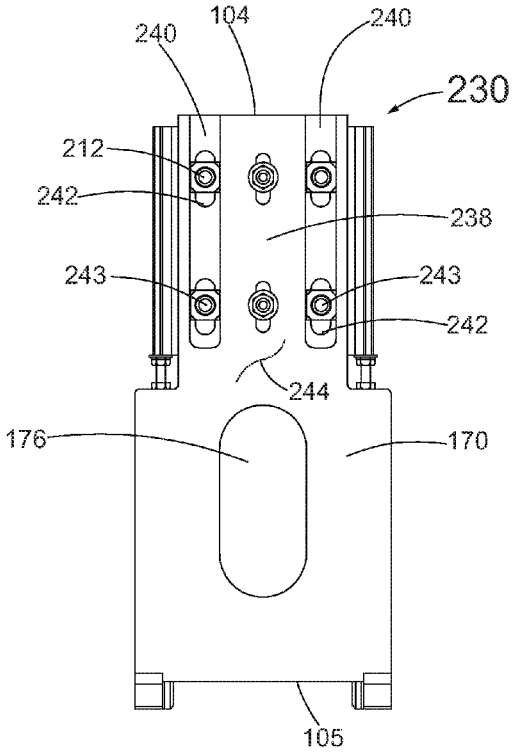
FIG. 9 is a rear elevational view of the front portion of the coupler shown in FIG. 1.
Figure 10:
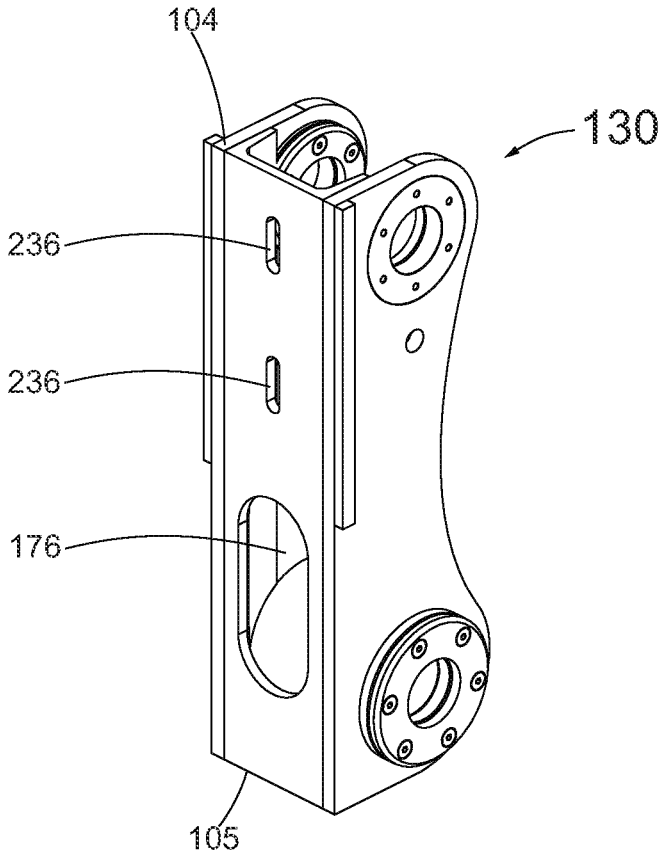
FIG. 10 is a front perspective view of a rear portion of the coupler shown in FIG. 1.

As is best shown in FIGS. 8-10, coupler 100 can be formed by two major assemblies or portions. These include rear portion 130 and a front portion 230 that can be secured relative to one another. These portions can have all of the features disclosed above and below. As is shown, fastener sets 234 can be used and these can be configured to pass through slotted openings 236 to allow selective relative movement between portion 130 and 230. Web 170 can include an upward extension 238 that extends upwardly toward top extent 104 wherein web 170 and web extension 238 can generally extend between top extent 104 and bottom extent 105. Again, these extents are intended for reference only and should not be narrowly interpreted. Extension 238 can include one or more rear slots 240 that include one or more T-Slots 242 for fastener sets 212. By including slots, 242, bolts 243 of sets 212 can be both recessed below back surface 244 and can be prevented from unwanted rotation to allow tightening of fastener sets 212 from the front side of the coupler. In addition, extension 238 can be narrower than web 170 to provide shoulders 246 for tightening system 220 described above.

While there are different types of attachment devices available today, they are limited to devices that attach working tools to working end 64 of dipper stick 40. However, coupler 100 allows the working tools to be joined directly to boom 24. This can include different types of dipper sticks to be attached to and detached from the excavator boom, but also allows other types of non-excavator implements, such as those used by a skid steer, to be attached directly to the boom. Yet further, coupler 100 can be installed and used without any alterations to either the boom or dipper stick. Even yet further, coupler allows for quick connecting and disconnecting dipper sticks; work tools; and other attachment coupler types at the boom-end of an excavator that have multiple mounting configurations since the coupler is adjustable.

In addition, coupler 100 can be mounted to the excavator boom using the same attachment means as the factory installed Dipper Stick, namely, the overall geometry and rotary joints are of similar enough geometry as the dipper stick that was removed, so that the coupler can be installed at that same location. More particularly, attachment pin opening 134 is a first closed rotary bushing/pin connection to hold the excavator's factory dipper stick connection pin 36 and upper attachment pin opening 132 is a second closed bushing/pin connection feature to hold the excavator's machine's factory dipper stick cylinder hinge pin 58. Therefore, to mount coupler 100 to the end of boom 24, the bottom of the coupler is pinned with to the boom using dipper stick connection pin 36 and the dipper stick cylinder is connected to the top of the coupler using dipper stick cylinder hinge pin 58. This connection is similar to the way the host excavator machine attaches to the factory dipper stick, therefore no alterations to the boom, or core machine are required to mount the coupler to the machine. The coupler connection is "semi-permanently" installed on the host excavator machine, meaning it is designed to stay installed at these connection points indefinitely, and subsequent "stick-objects" are attached to the coupler, and not directly to the excavator boom.

Then, forward side 107 of coupler 100 (facing away from the host machine), includes hook 110 and pin 112 that allow a simple, yet robust means of mating to the working tool, such as a dipper stick, skid steer tool, and/or other coupler types.

Figure 12:
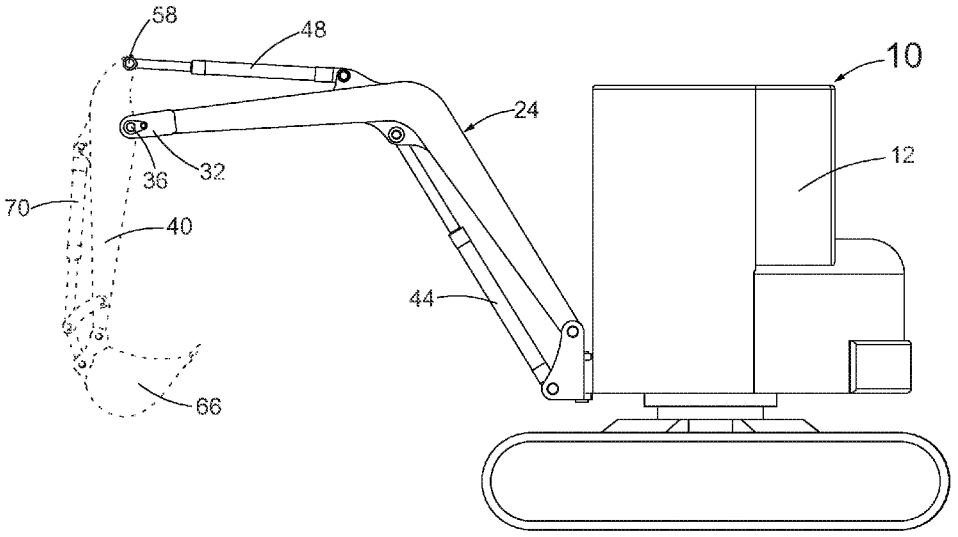
FIG. 12 is a side elevational view of the excavator shown in FIG. 11 with the dipper stick removed.
Figure 13:
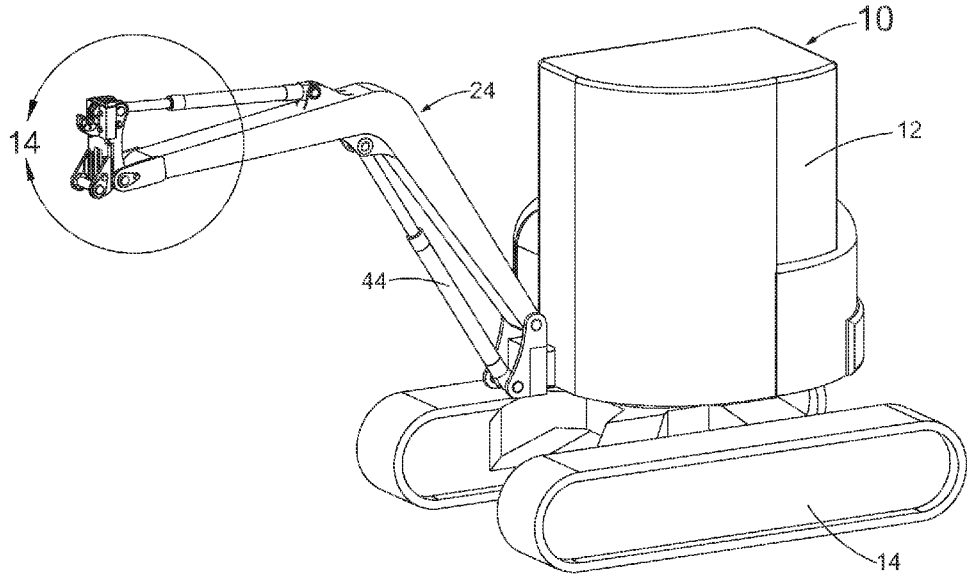
FIG. 13 is a side perspective view of the excavator shown in FIG. 11 with the coupler shown in FIG. 1.
Figure 14:
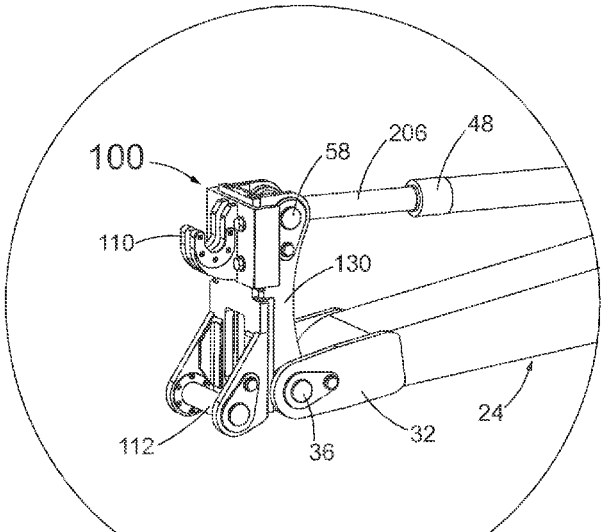
FIG. 14 is an enlarged view of a portion of the excavator shown in FIG. 13 showing the coupler.

With reference to FIGS. 12-20, shown are the removal of a dipper stick 250, the installation of coupler 100 and then the installation of dipping stick 250 according to certain aspects of the present invention. However, the same method can be used for a wide range of other working tools wherein this description is not to be limited to dipping sticks. FIG. 12 shows excavator 10 with dipper stick 40 removed. FIGS. 13 and 14 show coupler 100 installed directly on end 32 of boom 24.

Figure 15:
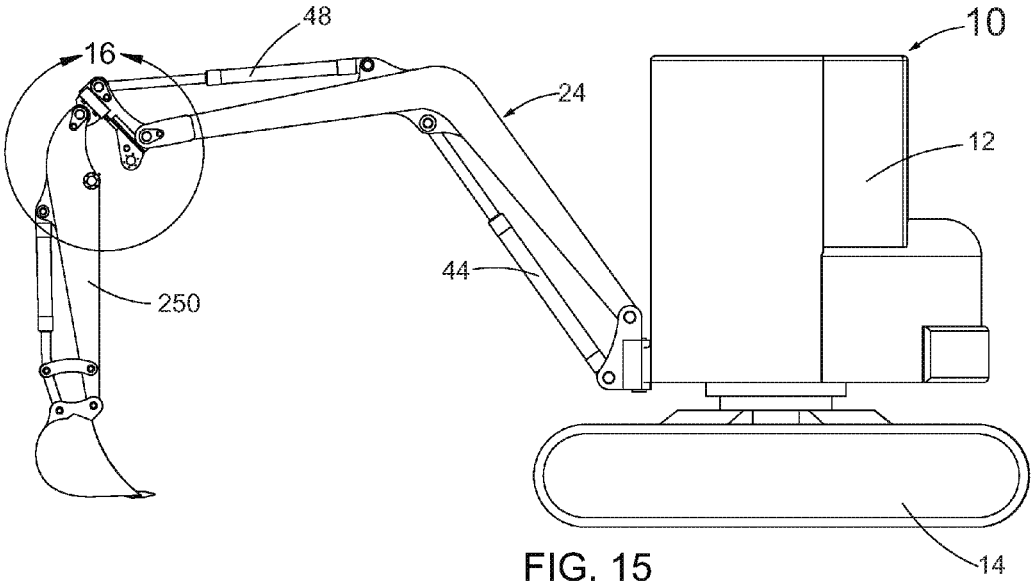
FIG. 15 is a side elevational view of the excavator shown in FIG. 11 with an upper hook of the coupler engaging a dipper stick.
Figure 16:
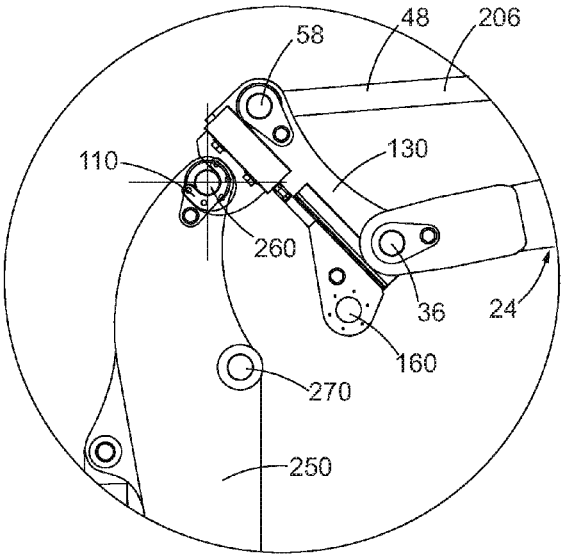
FIG. 16 is an enlarged view of a portion of the excavator shown in FIG. 15 showing the coupler.
Figure 17:
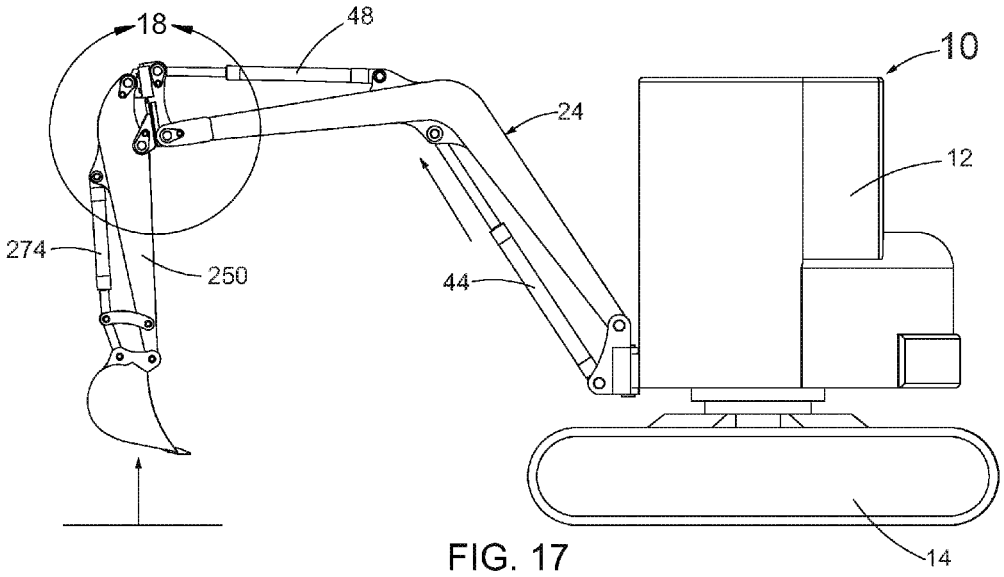
FIG. 17 is a side elevational view of the excavator shown in FIG. 15 with the dipper stick being rotated into position.
Figure 18:
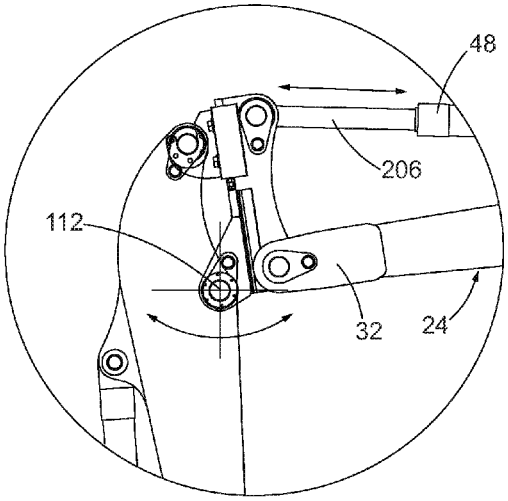
FIG. 18 is an enlarged view of a portion of the excavator shown in FIG. 17 showing the coupler engagement.
Figure 19:
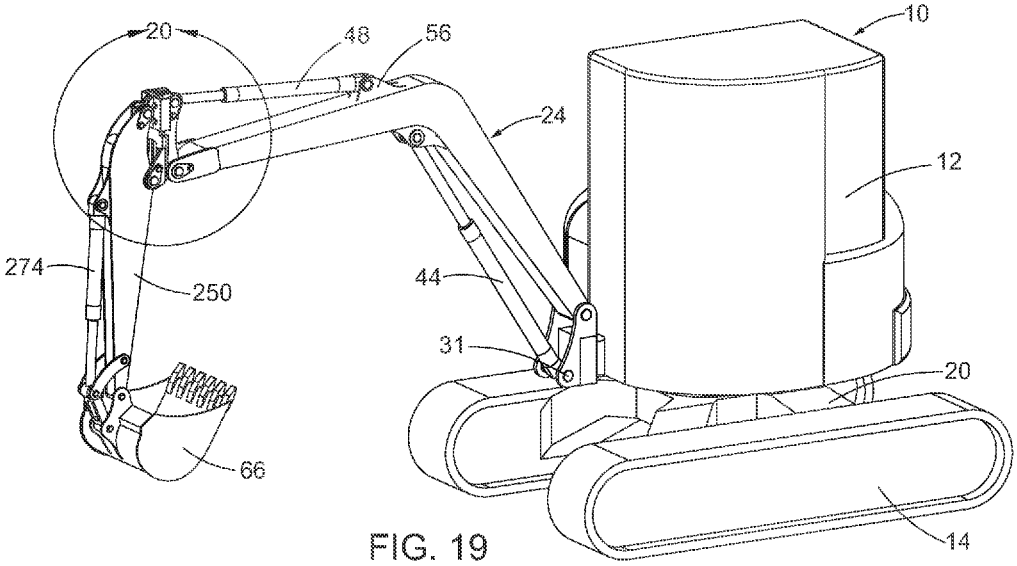
FIG. 19 is a side perspective view of the excavator shown in FIG. 17 with the dipper stick attached.
Figure 20:
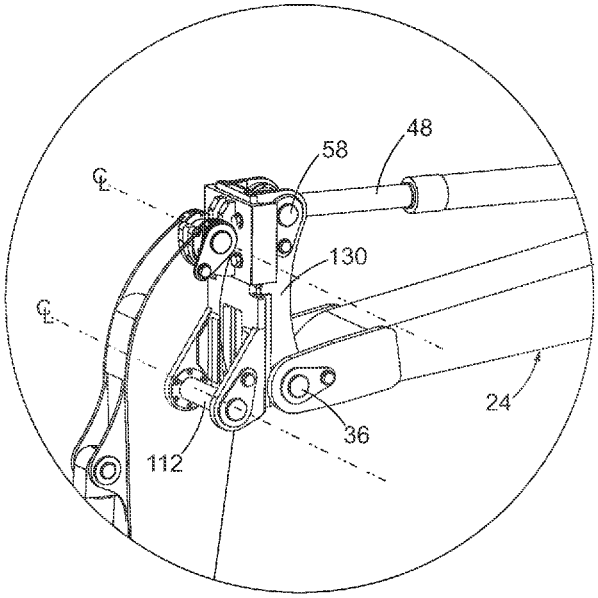
FIG. 20 is an enlarged view of a portion of the excavator shown in FIG. 19 showing the coupler and the attached dipper stick.
Figure 21:
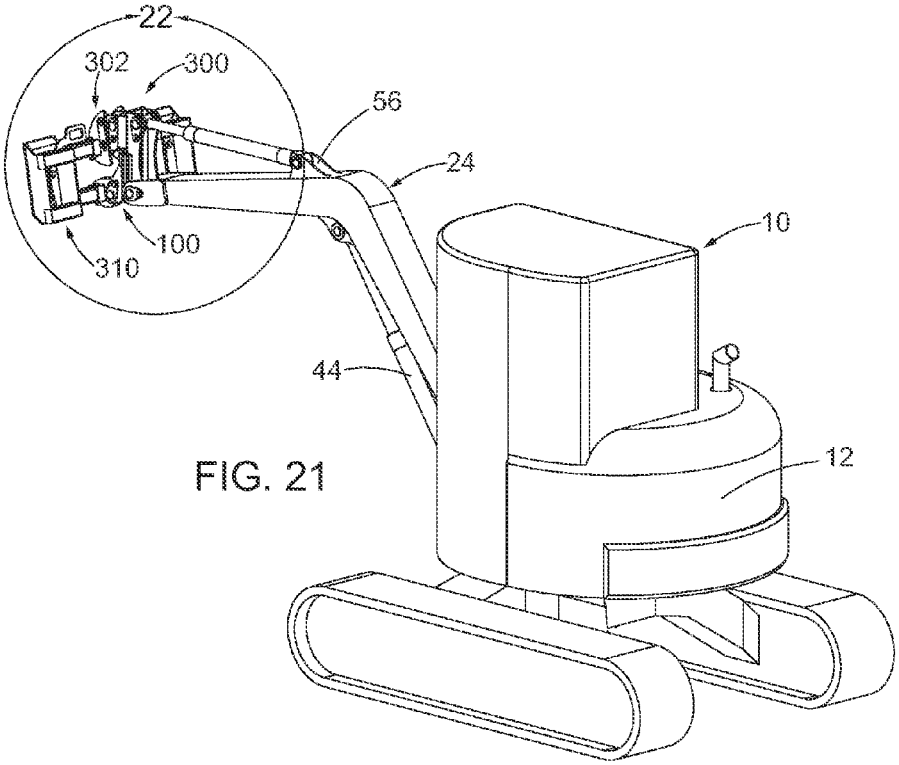
FIG. 21 is a rear perspective view of yet another embodiment of this application showing a coupler system with a universal skid steer adapter assembly.
Figure 22:
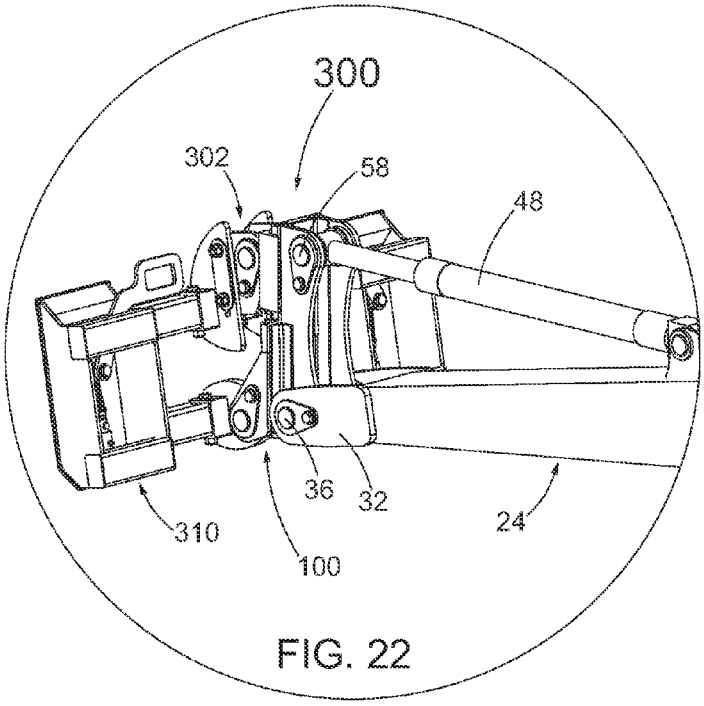
FIG. 22 is an enlarged view of a portion of the excavator shown in FIG. 21 showing the coupler engagement.
Figure 23:
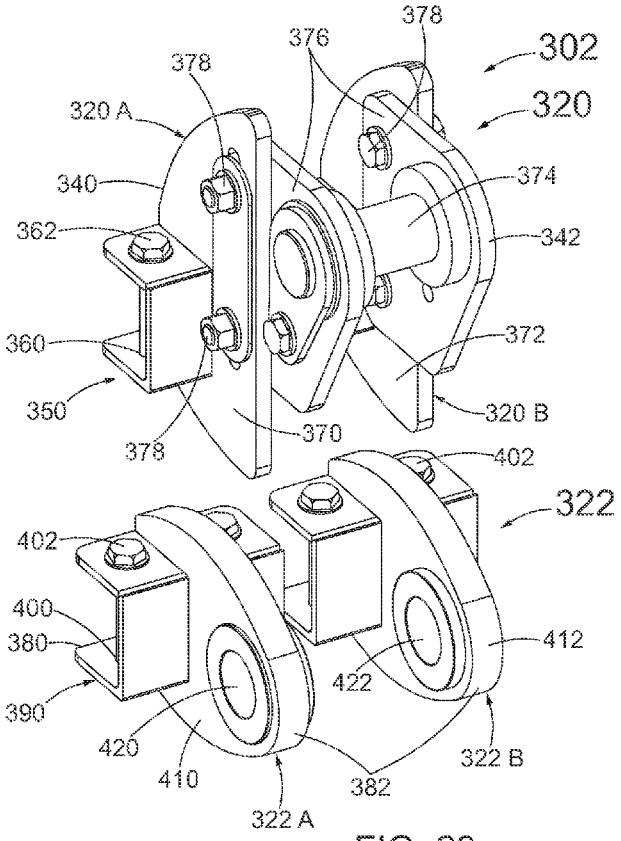
FIG. 23 is an enlarged rear perspective view of a coupler receiver of the system in FIG. 21 showing yet other aspects of the invention of this application.
Figure 24:
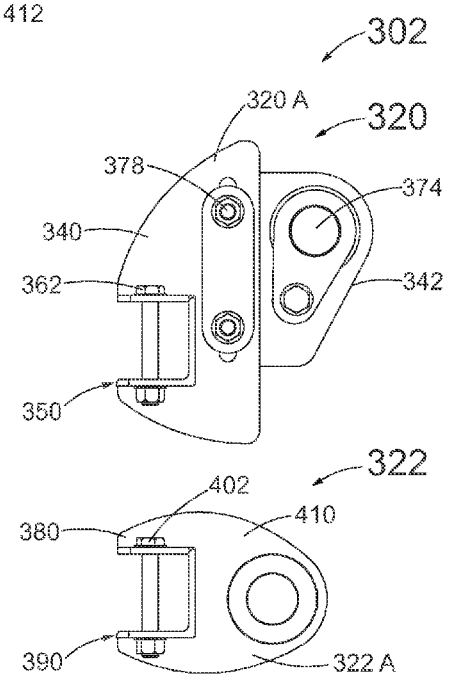
FIG. 24 is a side view of the coupler receiver shown in FIG. 23.

For the installation of dipper stick by way of coupler 100, and with special reference to FIGS. 15 and 16, the first step is to approach dipping stick 250 and target hook 110 to a dipper stick pin 260 of dipper stick 250. Next, boom 24 is manipulated so that hook 110 engages pin 260 as is best shown in FIG. 16. This is done by using the machine's boom cylinder and stick cylinder to adjust coupler 100 so that hook 110 engages pin 260. Once there is engagement, boom 24 is lifted to "lift" working tool or dipper stick 250 off the ground (i.e. dipper stick is fully suspended by the engagement between hook 110 and pin 260) as is shown in FIGS. 17 and 18. Once dipper stick 250 is fully suspended by hook 110, dipper stick 250 can swing about pin axis 260. And, using stick cylinder hydraulic cylinder 48, the coupler can be manipulated so that coupler pin openings or holes 160 align with boom hinge pin hole 270 of dipper stick 250 as is shown in FIG. 17. Once holes 160 and 270 are aligned, pin 112 is inserted and dipper stick 250 is fully mechanically attached to coupler 100 and ready for use as is shown in FIGS. 19 and 20. Yet further, in that the hydraulic lines that are used to manipulate boom 24 are maintained in an operating condition at all times, no connections are needed to operate the working tool. However, if the working tool has a separate operating line, such as the dipper stick shown that include bucket cylinder 274, the hydraulic line for this cylinder would need to be connected at this point. As referenced above, this line could be routed through openings 146, 176. Yet further, since pin 112 secures the coupler to the working tool, hook 110 can be a fixed permanently opened hook thereby greatly simplifying the overall design and manufacture of the coupler.

Yet further, in that hook 110 is adjustable, the alignment between holes 160 and 270 can be modified as is needed for different working tools. As can be appreciated, working distance or spacing 122 between hook 110 and pine 112 must match the distance between the two "fixed pin points" of the mating working tool assembly, thereby allowing pin 112 to be inserted without interference.

To remove dipper stick 250, the same sequence is repeated in reverse order.

Since coupler 100 according to certain aspects of the invention allows for use with compatible excavator dipper sticks; excavator tools, and other universal type attachment couplers, some of which already exist and are widely used, the invention of this application allows for the use of a wide variety of working tools on its modified boom arrangement. Yet further, it allows the skid steer implements to be mounted directly to boom 24, which makes the operation of these implements much more effective. This coupled with the mobility and revolving upper structure of an excavator makes for a very useful machine.

Overall, the invention of this application provides an excavator type machine having an easy means of attaching to and detaching from dipper stick objects that are attached to the boom end of an excavator. The advantages over a machine configurations not having the coupler is that it "fixes" all connection points for equal and quick alignment to mating stick object assemblies, and therefore attachment to those objects. During working tool installation coupler 100 also attaches first to the upper or top pin of the working tool (pin 260 in the example), which creates a top pivoting axis point that makes aligning holes 160 and 270 and the inserting of pin 112 a simple and quick process.

Without the coupler of this application, a top pin on the dipper stick cannot be attached first since cylinder 48 by itself has no structural properties for lifting or supporting the weight of the dipper stick. As a result, prior art systems require the lower boom hinge pin to be inserted first, which can be very difficult and time consuming, and may even require the assistance of another lifting device, because the entire weight of the dipper stick has to be manipulated by other means for proper alignment. This method of "hooking a pin" and allowing the weight of the object being connected to "swing" into proper alignment position with another concentric mating hole can be used on "bucket couplers" and this is unique in relation to the "end of the boom" location.

Since the coupler according to certain aspects of the invention allows for use with compatible excavator dipper sticks; excavator tools, and other universal type adapters/attachment couplers, all of which already exist and are widely used, the invention of this application allows for the use of a wide variety of working tools on its modified boom arrangement. Yet further, the coupler configuration could be modified to change the stroke of all those attachment tools as desired.

With reference to FIGS. 21-30, shown is a coupler system 300 that includes coupler 100 according to one or more of the embodiments disclosed above along with a coupler receiver 302 (best shown in FIGS. 23-26 discussed more below). In that coupler 100 has been fully described above, it will not be described in detail with relation to system 300 in the interest of brevity. Further, like reference numbers will be used in the description of these embodiments for clarity, but this is not intended to limit the invention of this application.

System 300 can help further facilitate the use of the coupler of this application with a wider range of working tools by adapting the coupler to other mounting systems used in the industry. In this respect, coupler receiver 302 is configured to be secured to coupler 100 similar to the dipper sticks like implements described in greater detail above. Coupler receiver 302 can include a wide range of features including, but not limited to, the required geometry to mount a skid steer implement directly to the receiver and/or a universal skid steer attachment system 310, which allows the implement to be mounted directly to excavator boom 24. Again, coupler receiver 302 is adapted to mount to the skid steer working tool and/or adapter and to coupler 100 by using the same attachment means that the dipper stick uses, namely, the overall geometry and rotary joints required to mount at the end-of-the boom location.

Again, coupler receiver 302 creates a system 300 that allows the use of coupler 100 with universal attachment systems that already exist and are widely used and known in the art wherein these will not be discussed in greater detail in the interest of brevity. Yet further, receiver 302 could also be used to change the coupler configuration to alter the stroke, angle of stroke and/or any other structural aspect of the working tool or implement used on excavator boom 24. Essentially, receiver 302 can be used as an adaptor and/or modifier to allow coupler 100 to be used for a wider range of applications, but still allowing coupler 100 to be used on dipper stick applications as described in greater detail above.

Shown in these figures is coupler system 300 that is used with a specific universal skid steer loader adapter assembly 310, but this is an example only wherein system 300 could be configured to work with other universal systems and/or on its own. In greater detail, system 300 includes receiver 302 and coupler 100. Coupler 100 is mounted to excavator boom 24 as described above and is selectively securable to receiver 302 to quickly change the type of working tools that can be secured to the boom.

With special reference to FIGS. 23-27, coupler receiver 302 includes an upper receiver assembly or portion 320 and a lower receiver assembly or portion 322. Upper portion 320 has a front side 340 and a rear side 342. Front side 340 includes a U-Channel 350 that is adapted to be selectively connectable to an upper rear horizontal bar 352 of universal adapter 310. The U-channel can include a wide range of mounting arrangements including, but not limited to, welded, fasteners, rivets, and the like for the connection. In that it is preferred that it is selectively securable, it is shown that U-channel 350 includes mounting openings 360 wherein fastener sets 362 can secure U-channel 350 to the upper rear bar. Rear side 342 of upper portion 320 includes a pair of mounting flanges 370 and 372 with an upper mounting pin 374 extending therebetween, which will be discussed more below. Flanges 370 and 372 can be single flange arrangement wherein pin 374 extends directly therebetween and/or can include one or more adjustment plates 376 that allow for vertical adjustment 377. In the embodiment shown, plates 376 are utilized and include fastener sets 378 to allow for the selective adjust of upper portion 302 relative to lower portion 322, which will be discussed more below. Further, upper portion 320 can be a single component or include a pair of components 302A and 302B positioned side-by-side with pin 374 joining the two components, as is shown.

Lower portion 322 has a front side 380 and a rear side 382. Front side 380 includes a U-Channel 390 that is adapted to be selectively connectable to a lower rear horizontal bar 392 of universal adapter 310. Again, the U-channel can include a wide range of mounting arrangements including, but not limited to, welded, fasteners, rivets, and the like for the connection. In that it is preferred that it is selectively securable, it is shown that U-channel 390 includes mounting openings 400 wherein fastener sets 402 can secure the U-channel to the lower rear bar. Rear side 382 of lower portion(s) 322 includes a pair of mounting flanges 410 and 412 including receiver pin opening 420 and 422, respectively, which will be discussed more below. As with upper portion 320, lower portion can be a single component or include a multiple components 322A and 322B positioned side-by-side, as is shown. Yet further, receiver 302 can also be adjust laterally by a lateral spacing 424 to allow the system to be used on an even greater number of machines.

Figure 27:
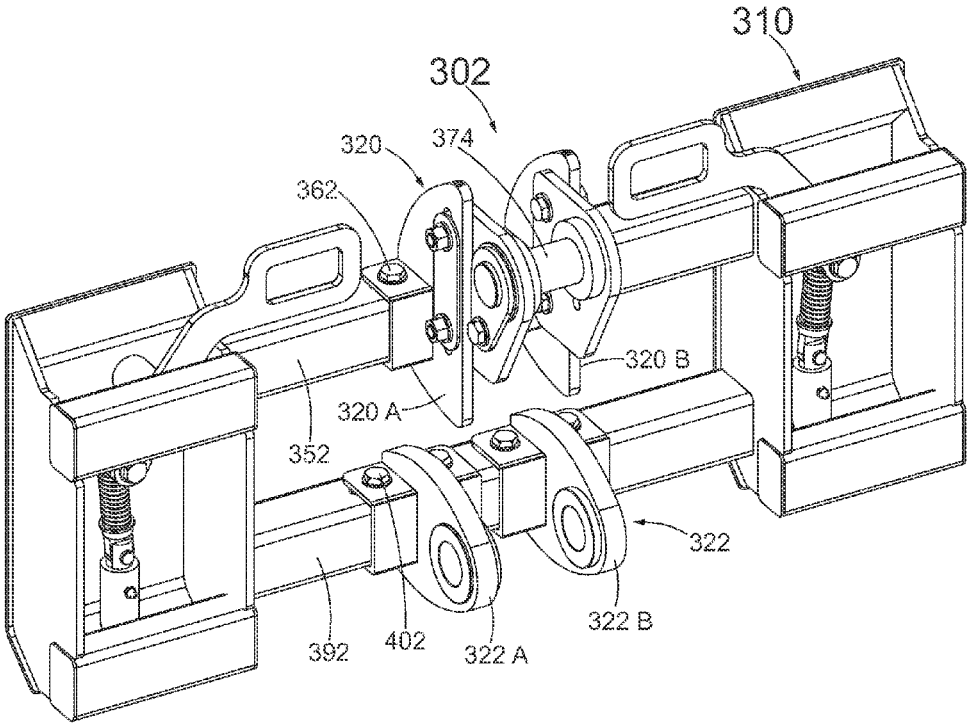
FIG. 27 is an enlarged rear perspective view of a coupler receiver of the system in FIG. 21 with the universal skid steer adapter assembly installed.

As is best shown in FIG. 27, when receiver 302 is joined to universal adapter 310, it produces a mounting arrangement similar to that of the dipper sticks discussed in greater detail above. Therefore, this arrangement can be secured directly to boom 24 by way of coupler 100 wherein upwardly facing hook 110 would engage pin 374 to lift the assembly off the ground. Once off the ground, the boom systems can manipulate receiver 302 and adapter 310 until receiver pin openings 420 and 422 align with coupler openings 160. Once in alignment, pin 112 can be inserted into position to effectively operably secure universal adapter 310 to the boom end of boom 24.

Figure 29:
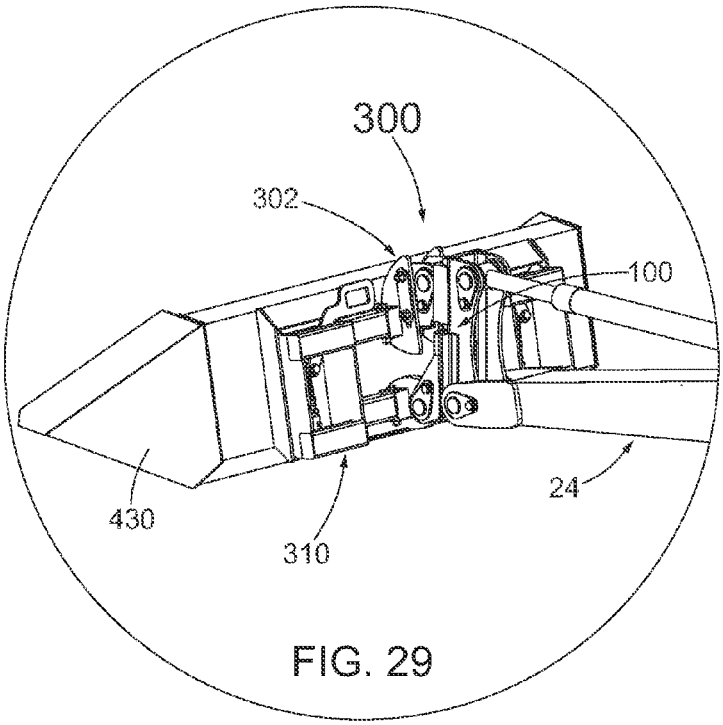
FIG. 29 is an enlarged view of a portion of the excavator shown in FIG. 28 showing the coupler engagement.
Figure 28:
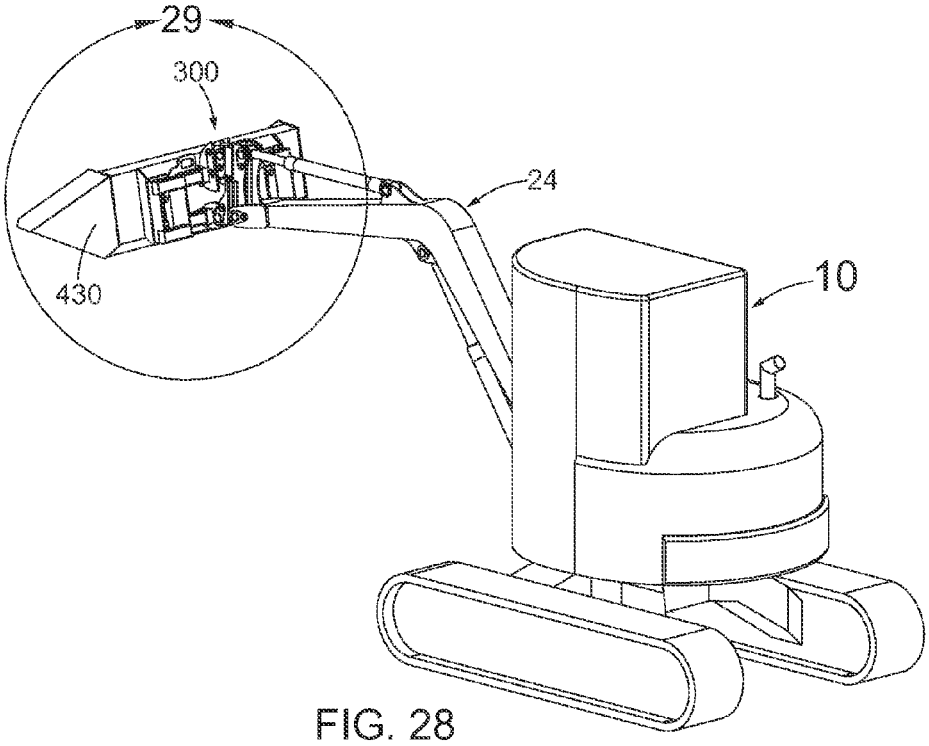
FIG. 28 is a rear perspective view of the excavator shown in FIG. 21 with a skid steer loader bucket attached.
Figure 31:
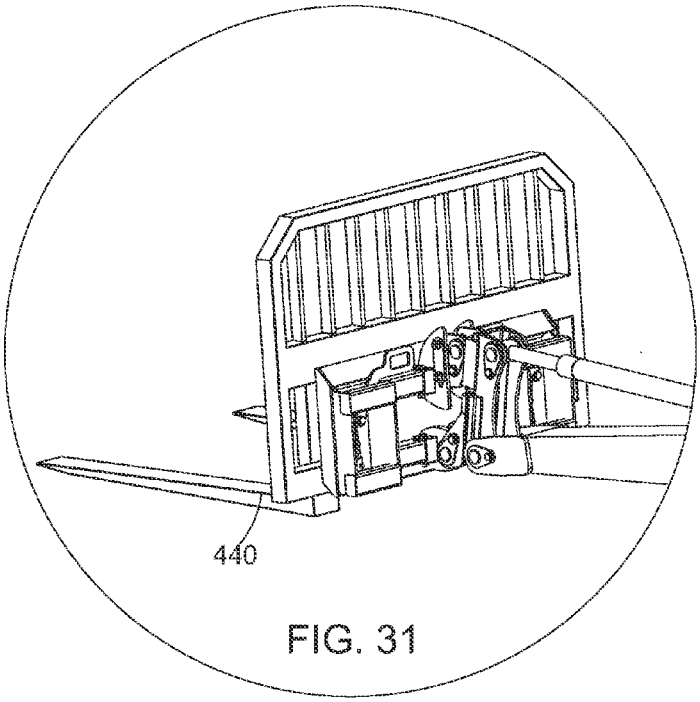
FIG. 31 is an enlarged view of a portion of the excavator shown in FIG. 30 showing the coupler engagement.
Figure 30:
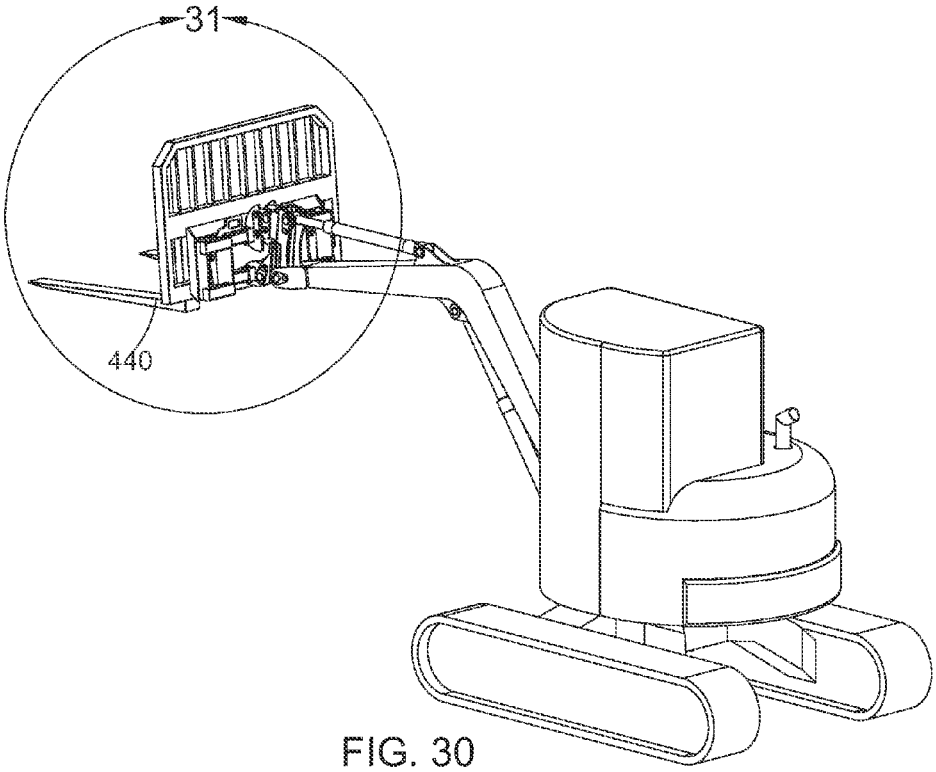
FIG. 30 is a rear perspective view of the excavator shown in FIG. 21 with a fork lift implement attached.
Figure 32:
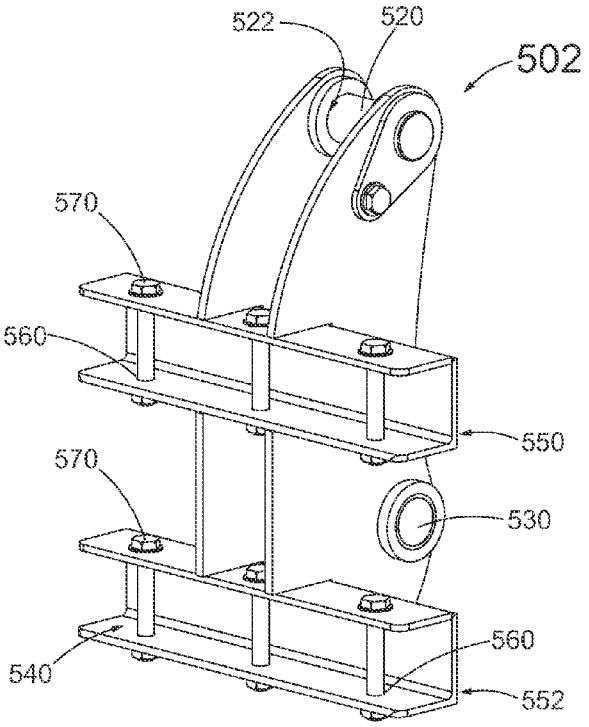
FIG. 32 is a front perspective view of another coupler receiver according to other aspects of the present invention.
Figure 33:
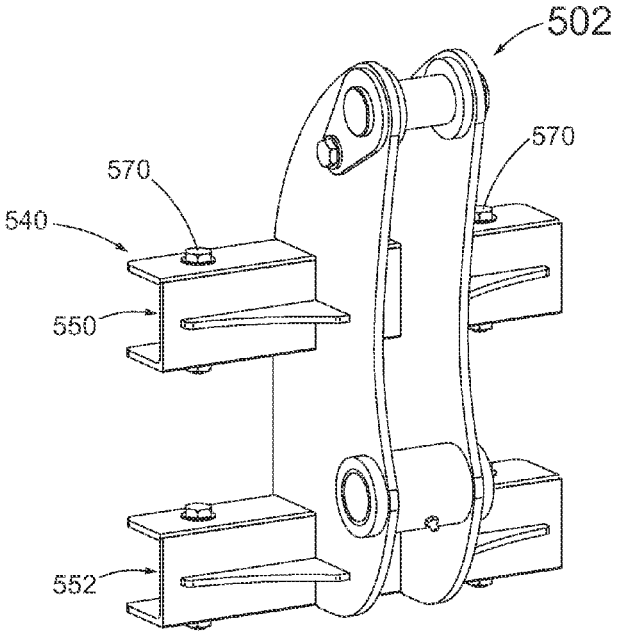
FIG. 33 is a back perspective view of the coupler receiver shown in FIG. 32.

With special reference to FIGS. 28-31, shown is system 300 used with two non-excavator type working tools 430 and 440 that share the universal skid steer mounting adapter arrangement. Again, these are examples only wherein this invention should not be limited thereto. In greater detail, FIGS. 28 and 29 show system 300 used in connection with a standard skid steer loader bucket 430. FIGS. 30 and 31 show system 300 used in connection with a standard fork lift implement 440. As a result, the invention of this application provides an easy and robust means to attach various types and styles of universal adapter couplers, and thereby universal work tools, to the "boom-end" of an excavator.

With reference to FIGS. 32-35, shown is a coupler system 500 that again can include a coupler 100 according to one or more of the embodiments disclosed above along with a coupler receiver 502 that can include one or more of the aspects of receiver 302 disclosed above. However, in the embodiment shown, receiver 502 is a "one piece" design that can function, at least in part, like receiver 302 discussed above. As with other systems of this application, system 500 can help further facilitate the use of the coupler of this application with a wider range of working tools by adapting the coupler to other mounting systems used in the industry.

As with system 300 above, coupler receiver 502 is configured to be secured to coupler 100 similar to the dipper sticks described in greater detail above, but could be used on its own too. Coupler receiver 502 also can include a wide range of features including, but not limited to, the required geometry to mount a universal skid steer adapter directly to the receiver, which allows the implement to be mounted directly to excavator boom 24. Again, coupler receiver 502 is adapted to mount to the skid steer working tool and to coupler 100 by using the same attachment means that the dipper stick uses, namely, the overall geometry and rotary joints required to mount to the end-of-the boom location.

Coupler receiver 502 also creates a system 500 that allows the use of coupler 100 with universal attachment systems that already exist and are widely used and known in the art wherein these will not be discussed in greater detail in the interest of brevity.

Figure 36:
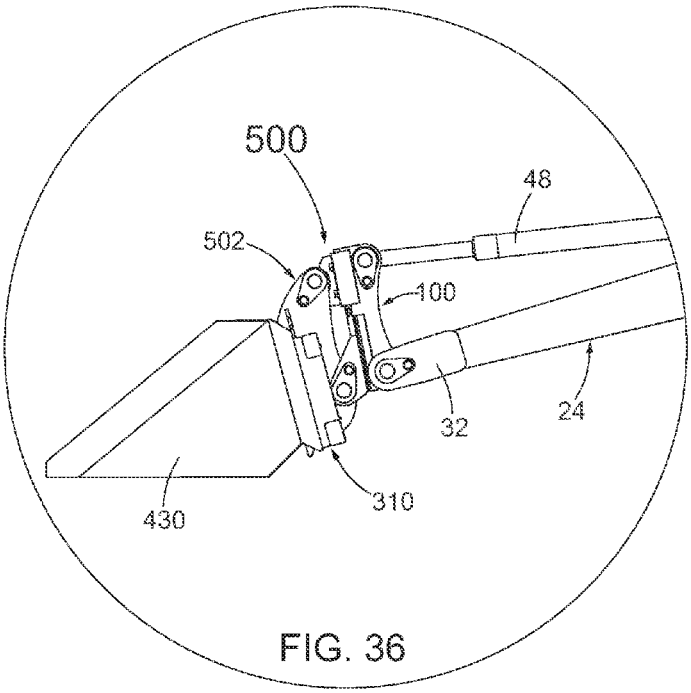
Figure 35:
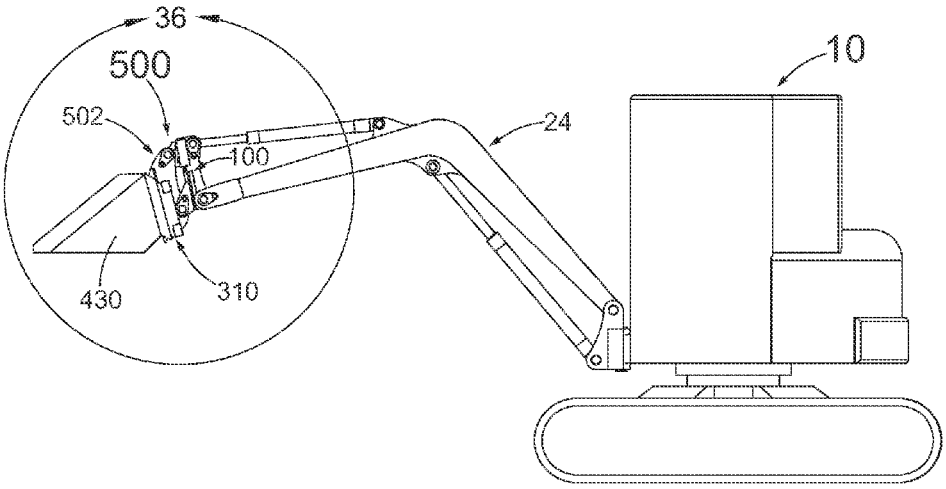
FIG. 35 is a side elevational view of the embodiment shown in FIG. 32 attached to a boom; and, FIG. 36 is an enlarged view of a portion of the excavator shown in FIG. 35 showing the coupler engagement.

With special reference to FIGS. 35 and 36, shown is coupler system 500 that includes receiver 502 and coupler 100 both mounted to excavator boom 24. Shown is a universal skid steer loader adapter assembly 310, discussed above, secured relative to coupler receiver 502 along with loader bucket 430 mounted to the end of boom 24 by way of coupler 100 and coupler receiver 502. Again, FIGS. 35 and 36 show another example of how a standard skid steer loader bucket 430 is attached by way of a standard skid steer loader adapter assembly 310, which is mated to the coupler receiver. As a result, the invention of this application provides an easy and robust means to attach various types and styles of universal adapter couplers, and thereby universal work tools, to the "boom-end" of an excavator. This particular embodiments shows that the receiver can be a single piece arrangement wherein the working components are all secured relative to one another, which is different than the four piece system 302 discussed above.

In operation, coupler 100, system 300 and/or system 500 have been found to not only allow for more working tools to be used, but have been found to greatly improve the performance of the tools. In this respect, coupler 100, system 300 and/or system 500 provide an easy way to attach the work tool coupler(s) and by default "work tools" directly to boom end 32 of excavator 10. This is important because by removing the "hinged" Dipper Stick, the excavator becomes a "rigid-boom" working machine while also having the unique "revolving upper structure" that is a built-in part of an excavator. Having a "rigid boom" gives the excavator the same one-piece frontal force advantages as other work machines (i.e. Skid-Steer Loaders, Track Loaders, Wheel Loaders, Front-end Loaders/Backhoe Loaders, Tele-handlers), but also allows for rotation. This combination then, (rigid boom with a revolving upper structure) provides a work machine with unique capabilities that are very useful in many circumstances. For example, using the machine's undercarriage along with the revolving upper-structure allows the operator to dig on one side of the excavator and dump on the other side without turning the excavator around thereby reducing wear and tear on the undercarriage, eliminating a traditional turning radius, reducing damage to the underlying ground surface and reducing work time.

Again, coupler receiver 502 could be a stand alone unit and be mounted directly to the working end of boom 24 and/or can be configured to work with coupler 100, which even further improves the flexibility of the system. As is shown, it is configured to work as a system and as a stand alone system. Coupler receiver 502 includes a top pin 520 in a top receiver pin opening 522 and a bottom receiver pin opening 530. Top pin 520 can be selectively removable to facilitate the installation and or removal of the coupler receiver to coupler 100 and/or boom end 32. In addition, coupler receiver 502 can also include any one of a wide range of work holding configurations 540 to adapt the couplers of this application to any one of, or multiple, universal mounting systems known in the art. Again, since these universal mounting systems are known in the art, they will not be discussed in great detail herein in the interest of brevity. However, work holding configurations allow system 500 to secure a wider range of implements to the boom end of an excavator.

Figure 34:
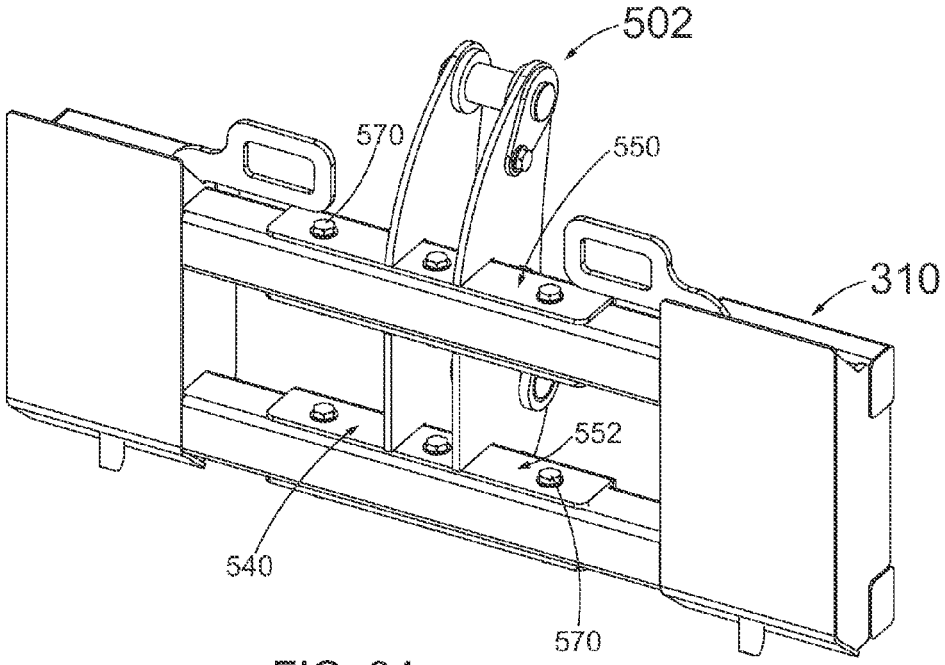
FIG. 34 is a front perspective view of the coupler receiver shown in FIG. 32 with the universal skid steer mounting adapter assembly.

Yet even further, system 300/500 could also include multiple receivers 302/502 to allow the system to work with an even greater number of working tools. As is shown, work holding configuration 540 includes parallel horizontal channels 550 and 552 having mounting holes 560, as discussed in greater detail above. The arrangement can further include fastener sets 570 to secure the adapter to the receiver. This arrangement allows adapter assembly 310 to be selectively mounted thereto as is best shown in FIG. 34. System 500 can work similarly to system 300 and/or coupler 100 wherein the operation of this embodiment will not be discussed in greater detail in the interest of brevity.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A coupler system for use on an excavation machine, the coupler system comprising a first coupler body extending between a top extent and a bottom extent, the first coupler body further including a first rearward portion and a first forward portion, the first rearward portion facing an associated working end of an associated lifting boom when in a first installed condition for the first coupler body, the first rearward portion having an upper attachment pin opening and a lower attachment pin opening, the upper attachment pin opening shaped to receive one of an associated dipper stick cylinder pin and an associated hinge pin, the lower attachment pin opening shaped to receive the other of the associated dipper stick cylinder pin and the associated hinge pin to selectively secure the first coupler body relative to the associated working end of the associated lifting boom such that the first coupler body is operably connectable to the associated lifting boom of an associated excavation machine and is pivotable relative to the associated lifting boom about a coupler axis, the first coupler body having a first mating arrangement; the coupler system further including a second coupler body, the second coupler body having a second forward portion and a second rearward portion, the second forward portion facing an associated universal adapter when in a second installed condition for the second coupler body and being securable relative to the associated universal adapter, the second coupler body including a second mating arrangement, the second mating arrangement being selectively securable to the first mating arrangement to selectively secure the associated universal adapter directly relative to the associated working end of the associated lifting boom of the associated excavation machine thereby allowing the associated excavation machine to use an associated skid steer attachment joined relative to the associated working end of the associated lifting boom of the associated excavation machine; the system further including a coupler lock to selectively lock the first coupler body relative to the second coupler body.

2. The coupler system according to claim 1, wherein the first mating arrangement includes an upwardly extending pin grabber hook and the coupler lock includes a coupler pin opening and a lower pin, the coupler pin opening being shaped to selectively support the lower pin and secure the second coupler body relative to the first coupler body, the pin grabber hook extending about a hook axis and the coupler pin opening extending about a pin axis, the second mating arrangement including a working tool pin and the pin grabber hook configured to selectively engage with the working tool pin.

3. The coupler system according to claim 2, wherein the first mating arrangement includes an upper forward portion and a lower forward portion, the upward forward portion including the upwardly extending pin grabber hook and the lower forward portion including the coupler pin opening, the pin grabber hook configured to selectively interengage with the working tool pin such that the upper hook can lift and support the associated universal adapter while the lower coupler pin opening is aligned.

4. The coupler system according to claim 3, wherein the upwardly extending pin grabber hook is fixed relative to the upward forward portion and is a permanently opened hook.

5. The coupler system according to claim 4, wherein the upwardly extending pin grabber hook is a pair of laterally spaced hooks.

6. A coupler system for use on an excavation machine, the coupler system comprising a first coupler body extending between a top extent and a bottom extent, the first coupler body further including a first rearward portion and a first forward portion, the first rearward portion facing an associated working end of an associated lifting boom when in a first installed condition for the first coupler body, the first rearward portion having an upper attachment pin opening and a lower attachment pin opening, the upper attachment pin opening shaped to receive one of an associated dipper stick cylinder pin and an associated hinge pin, the lower attachment pin opening shaped to receive the other of the associated dipper stick cylinder pin and the associated hinge pin to selectively secure the first coupler body relative to the associated working end of the associated lifting boom such that the first coupler body is operably connectable to the associated lifting boom of an associated excavation machine and is pivotable relative to the associated lifting boom about a coupler axis, the first coupler body having a first mating arrangement; the coupler system further including a second coupler body, the second coupler body having a second forward portion and a second rearward portion, the second forward portion facing a universal adapter and the second coupler body being attached to the universal adapter when in a second installed condition for the second coupler body, the universal adapter configured to selectively secure an associated skid steer attachment and to secure the associated skid steer attachment directly relative to the associated working end of the associated lifting boom, the second coupler body including a second mating arrangement, the second mating arrangement being selectively securable to the first mating arrangement to selectively secure the universal adapter directly relative to the associated working end of the associated lifting boom of the associated excavation machine thereby allowing the associated excavation machine to use the associated skid steer attachment joined relative to the associated working end of the associated lifting boom of the associated excavation machine; the system further including a coupler lock to selectively lock the first coupler body relative to the second coupler body.

7. The coupler system according to claim 6, wherein the first mating arrangement includes an upwardly extending pin grabber hook and the coupler lock includes a coupler pin opening and a lower pin, the coupler pin opening being shaped to selectively support the lower pin and secure the second coupler body relative to the first coupler body, the pin grabber hook extending about a hook axis and the coupler pin opening extending about a pin axis, the second mating arrangement including a working tool pin and the pin grabber hook configured to selectively engage with the working tool pin, the first mating arrangement includes an upper forward portion and a lower forward portion, the upward forward portion including the upwardly extending pin grabber hook and the lower forward portion including the coupler pin opening, the pin grabber hook configured to selectively interengage with the working tool pin such that the upper hook can lift and support the universal adapter while the lower coupler pin opening is aligned, the universal adapter and the working tool pin of the second mating arrangement includes a pin fixed relative to the universal adapter, the universal adapter configured to selectively secure the associated skid steer attachment and to secure the associated skid steer attachment directly relative to the associated working end of the associated lifting boom.

8. The coupler system according to claim 7, wherein the pin fixed relative to the universal adapter is a first pin, the working tool pin further including a second pin, the second pin being fixed relative to an associated dipper stick arrangement and forming part of a third mating arrangement, the second pin allowing both an associated dipper stick attachment and the universal adapter to be joinable relative to the associated working end of the associated lifting boom.

9. The coupler system according to claim 6, wherein the second coupler body is bolted to the universal adapter.

10. An excavation machine having a coupler system, the excavation machine comprising an upper structure pivotably joined to an under carriage frame to allow for rotation of the upper structure relative to the under carriage frame about a vertical axis, the excavation machine further including a lifting boom pivotably joined relative to the upper structure, the lifting boom having a base end joined relative to the upper structure of the excavation machine and extending between the base end and a distal end opposite of the base end, the distal end forming a working end of the lifting boom and which is movable relative to the upper structure about a boom axis, the lifting boom further including a boom cylinder and a dipper stick cylinder, the boom cylinder configured to control the up and down motions of the working end about the boom axis and the dipper stick cylinder configured to rotate an associated dipper stick about a working end axis, the working end of the lifting boom being connectable to the associated dipper stick, the coupler system comprising a first coupler body extending between a top extent and a bottom extent, the first coupler body further including a first rearward portion and a first forward portion, the first rearward portion facing the working end of the lifting boom when in a first installed condition for the first coupler body, the first rearward portion having an upper attachment pin opening and a lower attachment pin opening, one of the upper and lower attachment pin openings being shaped to receive a dipper stick cylinder pin and the other of the upper and lower attachment pin openings being shaped to receive a hinge pin to selectively secure the first coupler body relative to the working end of the lifting boom such that the first coupler body is operably connectable to the lifting boom of the excavation machine and is pivotable relative to the lifting boom about a coupler axis, the first coupler body having a first mating arrangement; the coupler system further including a second coupler body, the second coupler body having a second forward portion and a second rearward portion, the second forward portion facing an associated universal adapter when in a second installed condition for the second coupler body and being at least one of secured or securable relative to the associated universal adapter, the second coupler body including a second mating arrangement, the second mating arrangement being selectively securable to the first mating arrangement to selectively secure the associated universal adapter directly relative to the working end of the lifting boom of the excavation machine thereby allowing the excavation machine to use an associated skid steer attachment joined directly relative to the working end of the lifting boom; the system further including a coupler lock to selectively lock the first coupler body relative to the second coupler body.

11. The excavation machine according to claim 10, wherein the first mating arrangement includes an upwardly extending pin grabber hook and the coupler lock includes a coupler pin opening and a lower pin, the coupler pin opening being shaped to selectively support the lower pin and secure the second coupler body relative to the first coupler body, the pin grabber hook extending about a hook axis and the coupler pin opening extending about a pin axis, the second mating arrangement including a working tool pin and the pin grabber hook configured to selectively engage with the working tool pin.

12. The excavation machine according to claim 11, wherein the first mating arrangement includes an upper forward portion and a lower forward portion, the upward forward portion including the upwardly extending pin grabber hook and the lower forward portion including the coupler pin opening, the pin grabber hook configured to selectively interengage with the working tool pin such that the upper hook can lift and support the associated universal adapter while the lower coupler pin opening is aligned.

13. The excavation machine according to claim 12, wherein the upwardly extending pin grabber hook is fixed relative to the upward forward portion and is a permanently opened hook.

14. The excavation machine according to claim 13, wherein the upwardly extending pin grabber hook is a pair of laterally spaced hooks.

15. An excavation machine having a coupler system, the excavation machine comprising an upper structure pivotably joined to an under carriage frame to allow for rotation of the upper structure relative to the under carriage frame about a vertical axis, the excavation machine further including a lifting boom pivotably joined relative to the upper structure, the lifting boom having a base end joined relative to the upper structure of the excavation machine and extending between the base end and a distal end opposite of the base end, the distal end forming a working end of the lifting boom and which is movable relative to the upper structure about a boom axis, the lifting boom further including a boom cylinder and a dipper stick cylinder, the boom cylinder configured to control the up and down motions of the working end about the boom axis and the dipper stick cylinder configured to rotate an associated dipper stick about a working end axis, the working end of the lifting boom being connectable to the associated dipper stick, the coupler system comprising a first coupler body extending between a top extent and a bottom extent, the first coupler body further including a first rearward portion and a first forward portion, the first rearward portion facing the working end of the lifting boom when in a first installed condition for the first coupler body, the first rearward portion having an upper attachment pin opening and a lower attachment pin opening, one of the upper and lower attachment pin openings shaped to receive a dipper stick cylinder pin and the other of the upper and lower attachment pin openings being shaped to receive a hinge pin to selectively secure the first coupler body relative to the working end of the lifting boom such that the first coupler body is operably connectable to the lifting boom of the excavation machine and is pivotable relative to the lifting boom about a coupler axis, the first coupler body having a first mating arrangement; the coupler system further including a second coupler body, the second coupler body having a second forward portion and a second rearward portion, the second forward portion facing a universal adapter and the second coupler body being joined to the universal adapter when in a second installed condition for the second coupler body and being at least one of secured or securable relative to the universal adapter, the universal adapter configured to selectively secure an associated skid steer attachment and to secure the associated skid steer attachment directly relative to the working end of the lifting boom, the second coupler body including a second mating arrangement, the second mating arrangement being selectively securable to the first mating arrangement to selectively secure the universal adapter directly relative to the working end of the lifting boom of the excavation machine thereby allowing the excavation machine to use an associated skid steer attachment joined directly relative to the working end of the lifting boom.

16. The excavation machine according to claim 15, wherein the first mating arrangement includes an upwardly extending pin grabber hook and the coupler lock includes a coupler pin opening and a lower pin, the coupler pin opening being shaped to selectively support the lower pin and secure the second coupler body relative to the first coupler body, the pin grabber hook extending about a hook axis and the coupler pin opening extending about a pin axis, the second mating arrangement including a working tool pin and the pin grabber hook configured to selectively engage with the working tool pin, the first mating arrangement includes an upper forward portion and a lower forward portion, the upward forward portion including the upwardly extending pin grabber hook and the lower forward portion including the coupler pin opening, the pin grabber hook configured to selectively interengage with the working tool pin such that the upper hook can lift and support the universal adapter while the lower coupler pin opening is aligned, the universal adapter and the working tool pin of the second mating arrangement includes a pin fixed relative to the universal adapter, the universal adapter configured to selectively secure an associated skid steer attachment and to secure the associated skid steer attachment directly relative to the working end of the lifting boom.

17. The excavation machine according to claim 16, wherein the pin fixed relative to the universal adapter is a first pin, the working tool pin further including a second pin, the second pin being fixed relative to an associated dipper stick arrangement and forming part of a third mating arrangement, the second pin allowing both an associated dipper stick attachment and the universal adapter to be joinable relative to the working end of the lifting boom.

18. The excavation machine according to claim 15, wherein the second coupler body is bolted to the universal adapter used to selectively secure the associated skid steer attachment relative to the working end of the lifting boom.

* * * * *